US006700984B1

(12) United States Patent
Holberg et al.

(10) Patent No.: US 6,700,984 B1
(45) Date of Patent: Mar. 2, 2004

(54) NON-LINEARLY TAPERING TRANSMISSION LINE SPEAKERS

(75) Inventors: Tuomas Holberg, Caltech, CA (US); Marcel Gavriliu, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 304 days.

(21) Appl. No.: 09/733,625

(22) Filed: Dec. 7, 2000

Related U.S. Application Data

(60) Provisional application No. 60/169,499, filed on Dec. 7, 1999.

(51) Int. Cl.[7] ..... H04R 1/20

(52) U.S. Cl. ..... 381/338; 381/337; 181/199

(58) Field of Search ..... 181/212, 152, 181/155, 156, 159; 381/336, 337, 338, 341, 349, 350, 345, 354, 160, 339

(56) References Cited

U.S. PATENT DOCUMENTS 3,486,578 A * 12/1969 Albarino ..... 381/350
5,828,759 A * 10/1998 Everingham ..... 381/71.5
6,356,643 B2 * 3/2002 Yamagishi et al. ..... 381/349

OTHER PUBLICATIONS

Kinsler, Lawrence E., Fundamentals of Acoustics, 1982, John Wiley and Sons, Inc., 3rd Ed., 237–239.*

* cited by examiner

*Primary Examiner*—Curtis Kuntz
*Assistant Examiner*—Brian Ensey
(74) *Attorney, Agent, or Firm*—Fish & Richardson P.C.

(57) ABSTRACT

A nonlinearly tapering transmission line loudspeaker enclosure comprised of a waveguide whose cross sectional area is largest near the loudspeaker driver, and smallest at the terminal end. The transmission line nonlinearly tapers between the one end and the other end. The taper can be exponential or any other type of nonlinear taper.

3 Claims, 2 Drawing Sheets

NON-LINEARLY TAPERING TRANSMISSION LINE SPEAKERS

CROSS REFERENCE TO RELATED APPLICATIONS

This application claims the benefit of the U.S. Provisional Application No. 60/169,499, filed on Dec. 7, 1999.

BACKGROUND

Most loudspeakers consist of a transducer unit, often called "driver," and an enclosure of some sort. Many different forms of loudspeaker enclosures are known.

Loudspeaker drivers convert electric signals into sound. The quality of the sound output from a loudspeaker system depends not only on the quality of the driver unit itself, but also on the quality and the design of the enclosure. The combination of the characteristics of the loudspeaker driver and its enclosure may determine the overall performance and sonic signature of the loudspeaker system.

Loudspeaker drivers are often bipolar transducers, in that they produce sound both from both their front and rear. The sound fields produced at these opposite ends of the driver are out of phase and combine destructively reducing output in the low frequency domain of the audible range.

One class of loudspeaker enclosures uses acoustic waveguides to process the output from the rear of the driver and reverse its phase, resulting in constructive interference, which enhances the output of the system in the low frequency domain. These enclosures are known as transmission lines. Transmission lines presently used have tubes with constant or linearly tapering cross sections, with the driver mounted at the end with the larger cross section. Disadvantages of this approach include the fact that the waveguide only reverses the phase of certain frequencies that are related to the acoustic length of the transmission line. This causes destructive interference to occur at the frequencies whose phase is not reversed, producing sound output that is not constant with the frequency of the reproduced sound.

Horn loudspeakers are also known. A horn loudspeaker has a tapering tubular waveguide with the driver mounted at the end of smaller cross section, and an enclosure at the rear of the driver. The horn acts as a high pass filter/amplifier, thereby enhancing the output of the driver above a certain frequency. Size limitations often limit horn sizes in practice for mid-high frequency domain of the audible spectrum.

SUMMARY

The present application describes a transmission line loudspeaker, which uses a non-linearly tapering acoustic waveguide.

In specific embodiments that are disclosed herein, the non-linearly tapering transmission lines may preserve the benefits of the conventional transmission line designs. In addition, non-linearly tapering transmission lines act as low pass filters, thereby attenuating the high frequency components of the sound produced at the rear of the driver which, in a conventional transmission line, would combine destructively with the high frequency components of the sound radiated at the front of the driver. This results in smoother overall frequency response of the loudspeaker system. Non-linearly transmission lines also permit a greater amount of impedance matching between the driver and the waveguide, resulting in improved transient response, reduced distortion, and a smoother and less dramatic decay in sound output below the resonant frequency of the system.

The driver may be placed at the largest opening of the transmission line, and a transmission line is caused to nonlinearly taper towards its terminus or output. The transmission line may be folded over itself to increase its length.

BRIEF DESCRIPTION OF THE DRAWINGS

These and other aspects of the invention will be described in detail with reference to the accompanying drawings, wherein.

DETAILED DESCRIPTION

Figure 1:
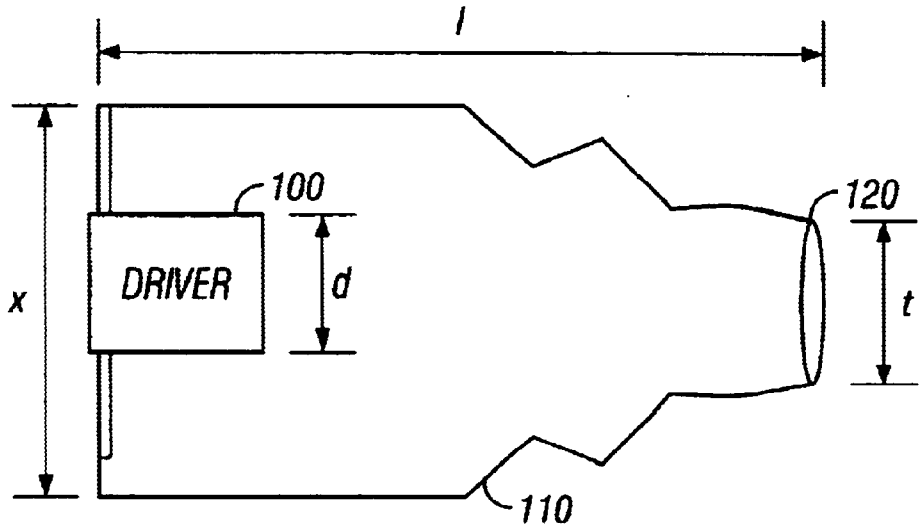
FIG. 1 shows a basic diagram of the nonlinearly tapering transmission line loudspeaker system

The basic layout of the non-linearly tapering transmission line loudspeaker system is shown in FIG. 1. A driver 100 of diameter "d" is mounted at the end with larger cross sectional area of a non-linearly tapering waveguide 110 filled with acoustic fibers. The taper could be, but is not limited to, exponential, hyperbolic, parabolic, a "tractrix", or any combination of such tapers the exponential, hyperbolic, parabolic and polynomnial papers are respectively shown in figures three a-3-D. Different parts of the line can be optimized to achieve certain design goals, such as frequency response, transient response, imnpedance, or distortion constraints. The end of the waveguide holding the driver has a diameter denoted as "x", the length of the waveguide is denoted by "l", while the diameter of the other and, called the terminus 120, is denoted by "t." Unlike other transmission line loudspeakers, the non-linearly tapering waveguide forms a low pass filter which limits the sound output coming out of the terminus to the lower frequency of the audible spectrum. This attenuation of higher frequencies is exhibited even in the absence of the acoustic fibers. Non-linear tapers may also exhibit lower distortion, flatter impedance curves, and better transient response.

Figure 2:
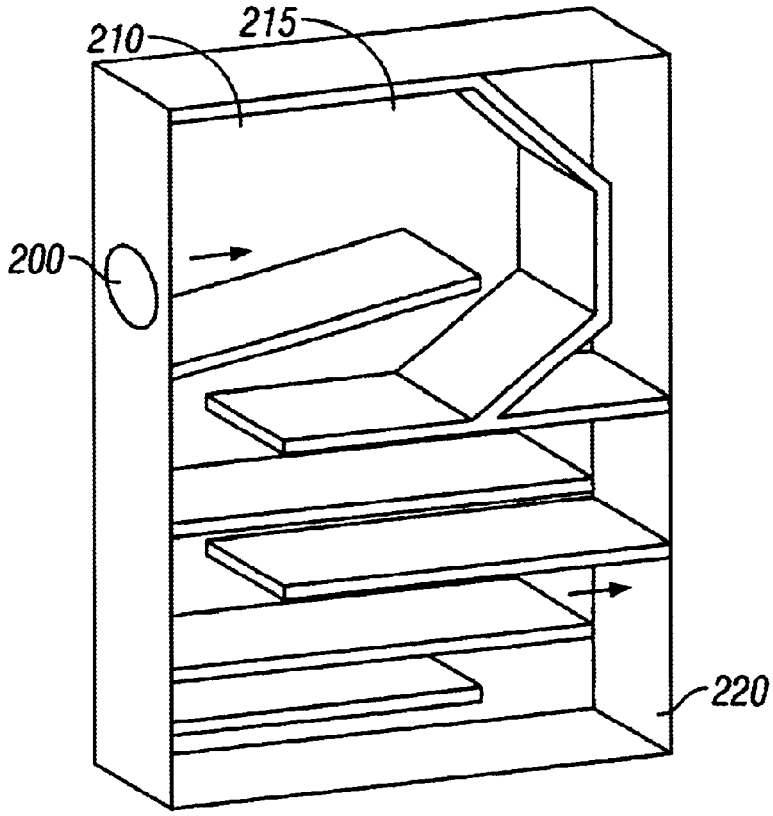
FIG. 2 shows a specific embodiment of a prototype system.
Figure 3A:
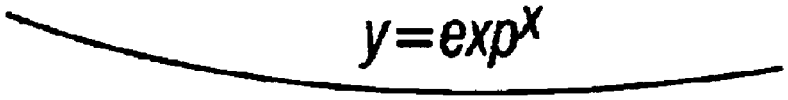
FIGS. 3A–3D respectively show exponential taper hyperbolic taper, parabolic taper and polynomial papers.
Figure 3B:
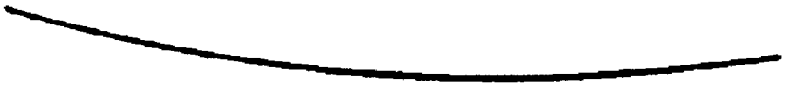
Figure 3C:
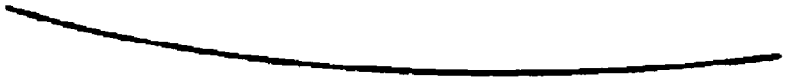
Figure 3D:
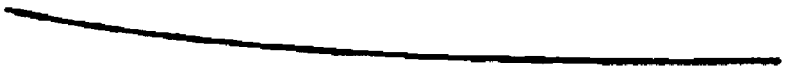

A specific embodiment is shown in FIG. 2. This embodiment used a driver 200 manufactured by Cabasse Electroacoustique, model 21NDC, with diameter d of 8 inches. The driver is a woofer type driver, with low Qts, resonant frequency of about 34 Hz, high linear excursion, and low distortion. The enclosure is designed to have a resonant frequency approximately equal to the resonant frequency of the driver.

In a correctly tuned system the amount of energy stored by the transmission line is minimized. A correctly tuned system will also exhibit lower distortion and a flatter impedance. It is often difficult to form a mathematical model of a transmission line, so a transmission line may be tuned by trial and error.

The initial length of the waveguide is computed similarly with conventional linearly tapering transmission lines as a function of the driver's resonant frequency. The system resonant frequency of the waveguide and driver combination is tuned by adjusting the amount of acoustic fibers that are packed inside the waveguide.

In the enclosure shown in FIG. 2 the initial cross-sectional area 210 of the transmission line is about 2½ times that of the driver—i.e. 126 square inches. This cross-sectional area tapers down to an output cross-sectional area 220, which is about 30 square inches at the terminus. The taper is exponential in this particular example, and is built of individual linearly tapering sections for ease of construction. Actual exponential shapes may perform even better.

The length of the overall line is about 2.25 meters. The length is bent over itself approximately five times in order to make the size of the overall enclosure more reasonable. The terminus preferably faces in the same direction as the woofer as shown in FIG. 2.

An initial area 215 may be insulated with a mixture of longhaired wool and fiberglass in order to attenuate higher frequencies and decrease the speed of sound. This may make the waveguide appear longer and may allow using shorter line lengths. As shown, the size of the enclosure may be changed in order to produce the results described herein.

The systems used herein may have a number of significant advantages. The non-linear taper of the waveguide may be made to prevent sound waves generated at the rear of the driver reflecting back through the driver. The back wave reflection could otherwise cause destructive interference, deteriorating the frequency response of the loudspeaker system. An exponential transmission line as described above may have lower distortion than conventional transmission lines. This system can also be made smaller than a conventional transmission line of comparable length, because non-linear tapers require less internal volume. Moreover, energy stored within the transmission line can be reduced, and impedance curves can be flatter resulting in better resonant behavior.

The bass response can also be extended lower than a conventional loudspeaker with the same driver. The decay in output below the resonant frequency of the system is slower than for other types of enclosures.

Conventional transmission lines (straight pipes or linearly tapering transmission lines) have many benefits over conventional enclosure designs. Transmission lines allow the woofer to achieve lower bass frequencies than a conventional enclosure. The backwave of the woofer in a conventional system may reflect off of the back wall and cause interference with the primary wave. In an exponentially tapering transmission line this backwave reflection is smaller than a conventional loudspeaker and may be smaller than that of a conventional transmission line. A non-linearly tapering transmission line may also act as a sharper low pass filter and the undesired higher harmonics of a conventional transmission line are minimized. An exponential transmission line may also be made smaller than a conventional transmission line as the exponential taper can be made very steep, thus will require less internal volume to achieve the same length.

A modification also possible is to place the driver not at the front of the transmission line but somewhere in between the front and terminus thus blending a horn system with that of a transmission line. This will place two filters on the acoustic signatures of the driver. A low pass filter on the backwave and a high pass filter on the front wave. If the intersection between the front sections and back sections are continuous to first order the summed frequency response of the front wave and back wave will be coherent at the point where the frequencies of the waves combine.

This system described above may also be used for any device that involves movement or flow of the fluid either liquid or gas. The nonlinear transmission line becomes a low pass filter and thereby removes high frequencies. This can include but is not limited to, exhaust mufflers, air-conditioning or heating ducts, and other similar systems.

Although only a few embodiments have been disclosed in detail above, other modifications are possible. All such modifications are intended to be encompassed within the following claims:

What is claimed is:

1. A speaker system, comprising:

a waveguide enclosure with non-linearly tapering cross sectional area along a straight line axis, which area defines at least one of an exponential taper, a hyperbolic taper, a parabolic taper or a polynomial taper having a plurality of wall portions, and; a speaker driver having an axis and mounted at the end of larger cross sectional area of the said waveguide enclosure, said axis of the speaker driver mounted along said straight line axis of said waveguide enclosure, wherein said wall portions are formed to make a low pass filter.

2. A method, comprising:

forming a loudspeaker enclosure using an acoustic waveguide which has one of an exponential taper, a hyperbolic taper, a parabolic taper, a polynomial taper along a straight line axis thereof, which has its, largest cross sectional area a position of a speaker driver, and is smallest at an opposite end said speaker having an axis and said axis of the speaker driver mounted along said straight line axis of said wave guide, wherein said forming comprises forming a low pass filter for said loudspeaker.

3. A method as in claim 2 further comprising tuning said loudspeaker cavity to a resonant frequency of said loudspeaker.

* * * * *